US012280419B2

(12) United States Patent
Shimomura et al.

(10) Patent No.: US 12,280,419 B2
(45) Date of Patent: Apr. 22, 2025

(54) ELECTRIC SQUEEZE DEVICE

(71) Applicant: METALS ENGINEERING KABUSHIKI KAISHA, Takaoka (JP)

(72) Inventors: Kouichi Shimomura, Takaoka (JP); Daisuke Funaki, Takaoka (JP); Yuso Kanehira, Takaoka (JP)

(73) Assignee: METALS ENGINEERING KABUSHIKI KAISHA, Takaoka (JP)

( * ) Notice: Subject to any disclaimer, the term of this patent is extended or adjusted under 35 U.S.C. 154(b) by 0 days.

(21) Appl. No.: 18/710,235

(22) PCT Filed: Nov. 24, 2022

(86) PCT No.: PCT/JP2022/043397
§ 371 (c)(1),
(2) Date: May 15, 2024

(87) PCT Pub. No.: WO2023/195200
PCT Pub. Date: Oct. 12, 2023

(65) Prior Publication Data

US 2025/0025934 A1 Jan. 23, 2025

(30) Foreign Application Priority Data

Apr. 6, 2022 (JP) ..... 2022-063677

(51) Int. Cl.
*B22C 15/06* (2006.01)

(52) U.S. Cl.
CPC ..... *B22C 15/06* (2013.01)

(58) Field of Classification Search
CPC ..... B22C 15/00; B22C 15/02; B22C 15/06
See application file for complete search history.

(56) References Cited

U.S. PATENT DOCUMENTS 5,682,941 A 11/1997 Oda

FOREIGN PATENT DOCUMENTS

| | | | |
|---|---|---|---|
| JP | 51-079065 | A | 7/1976 |
| JP | H03-238200 | A | 10/1991 |
| JP | H08-164444 | A | 6/1996 |
| JP | 2004-017089 | A | 1/2004 |

OTHER PUBLICATIONS

International Search Report for PCT/JP2022/043397 mailed Jan. 24, 2023.

*Primary Examiner* — Kevin P Kerns
*Assistant Examiner* — Steven S Ha
(74) *Attorney, Agent, or Firm* — Schmeiser, Olsen & Watts LLP

(57) ABSTRACT

An electric squeeze device is provided and includes: an electric squeeze device includes: a squeezing frame that applies a pressurizing force to the casting sands, a swing arm that is positioned on an upper side of the squeezing frame and reciprocates at a predetermined angle with respect to a rotation center; a link having one end side connected to a position of a radius of rotation A from the rotation center O of the swing arm and another end side connected to the squeezing frame; a driven gear formed along a virtual arc of a radius of rotation B from the rotation center of the swing arm; a drive gear that meshes with the driven gear; and an electric motor that rotationally drives the drive gear.

7 Claims, 7 Drawing Sheets

ELECTRIC SQUEEZE DEVICE

CROSS-REFERENCE TO RELATED APPLICATIONS

This application is a national stage of PCT Application No. PCT/JP2022/043397, having a filing date of Nov. 24, 2022, based on Japanese Application No. 2022-063677, having a filing date of Apr. 6, 2022, the entire contents both of which are hereby incorporated by reference.

FIELD OF TECHNOLOGY

The following relates to an electric squeeze device that compresses casting sands filled in a molding flask from above to make a mold.

BACKGROUND

In a squeeze device that compresses casting sands filled in a molding flask from above to make a mold, a high pressurizing force is required at the time of squeezing the casting sands. As a power source for generating the pressurizing force, a hydraulic pump unit having a hydraulic pump, a pressure control valve, a directional selecting valve, and the like loaded thereon, is used. However, in a case of using the hydraulic pump unit, an apparatus increases in size and the hydraulic pump is continuously operated during the molding operation, so that the amount of power to be used increases. In order to solve such a problem, an electric squeeze device that generates a pressurizing force using an electric motor may be used instead of the hydraulic pump unit.

SUMMARY

An example of the electric squeeze device is one indicated in Japanese Patent Application Laid-Open No. 8-164444 described above. The squeeze device described in Japanese Patent Application Laid-Open No. 8-164444 converts a rotational motion of an electric motor into a linear motion by a rotational motion conversion means which uses a ball screw mechanism. However, the ball screw mechanism is configured from precision components, and in a case of being installed in a foundry, a defect due to the influence of powder dust is concerned, resulting in troubles caused by the maintenance management.

In addition, as another configuration of converting the rotational motion of the electric motor into the linear motion, a configuration in which a crankshaft is used is also conceivable (for example, see Japanese Patent Application Laid-Open No. 2004-17089 described above). However, in a case of using the crankshaft, the stroke amount of a linearly moving conrod is defined by the amount of eccentricity of the rotating crankshaft. Therefore, when the height of a molding flask increases, the amount of filled sands increases, whereby the compression stroke also increases. In order to increase the compression stroke, it is necessary to increase the amount of eccentricity of the crankshaft, and it is also necessary to increase the rotational torque of the crankshaft, resulting in a problem that the output of the electric motor for rotating the crankshaft increases.

In view of the above circumstances as a background, embodiments of the present invention aims to provide an electric squeeze device that is configured from simple components and allows easy maintenance management and change in the stroke amount.

As a result of intensive studies to solve the above problems, the present inventors have conceived of embodiments of the present invention to be described below.

An electric squeeze device of a first aspect of embodiments of the present invention is defined as follows. That is,

- an electric squeeze device that compresses casting sands filled in a molding flask from above to make a mold, includes:
- a squeezing frame that applies a pressurizing force to the casting sands;
- a swing arm that is positioned on an upper side of the squeezing frame and reciprocates at a predetermined angle with respect to a rotation center;
- a link having one end side connected to a position of a radius of rotation A from the rotation center of the swing arm and another end side connected to the squeezing frame;
- a driven gear formed along a virtual arc of a radius of rotation B from the rotation center of the swing arm;
- a drive gear that meshes with the driven gear; and
- an electric motor that rotationally drives the drive gear, and
- a normal and reverse rotation of the electric motor causes the squeezing frame to move up and down via the swing arm and the link, and a size of the radius of rotation B is set to be larger than a size of the radius of rotation A, thereby increasing a downward pressurizing force applied to the squeezing frame.

In the electric squeeze device of the first aspect as defined above, the electric motor is used as a power source for generating a pressurizing force in place of a hydraulic pump unit, and the size of the radius of rotation B in the swing arm interposed between the electric motor and the squeezing frame is set to be larger than the size of the radius of rotation A (based on the principle of leverage), thereby increasing the downward pressurizing force applied to the squeezing frame. This electric squeeze device is configured from simple components without using ball screws or the like, so that it is possible to reduce troubles caused by the maintenance management. Furthermore, even in a case where it is necessary to change a raising and lowering stroke of the squeezing frame due to an increase or decrease in the amount of filled sands, it is possible to easily cope with the change in the stroke by changing the movement amount of the driven gear meshed with the drive gear.

Here, the driven gear is configured from a rack-shaped gear having a meshing portion provided so as to be curved in an arc shape, and the drive gear is configured from a pinion gear (second aspect).

A third aspect of embodiments of the present invention is defined as follows. That is, in the electric squeeze device defined in the first aspect or the second aspect, a connecting portion with the link in the swing arm is located on the driven gear side relative to the rotation center.

According to the electric squeeze device of the third aspect as defined above, it is possible to increase the proportion of the radius of rotation B with respect to the radius of rotation A without increasing the installation space of the device, and it is possible to further increase the downward pressurizing force applied to the squeezing frame.

A fourth or fifth aspect of embodiments of the present invention is defined as follows. That is,

- the electric squeeze device defined in the first or second aspect corresponding to the fourth aspect, or the third aspect corresponding to the fifth aspect, further includes:

a squeezing foot that is fitted to a cylinder portion formed in the squeezing frame and is movable forward and backward in a contact/separation direction with respect to the casting sands; and a back pressure adjustment means that detects a back pressure acting on a rear end side of the squeezing foot when the squeezing foot pressurizes the casting sands, and, in a case where the back pressure exceeds a predetermined threshold, discharges oil from an oil passage communicated with the cylinder portion to reduce the pressure to the threshold.

According to the electric squeeze device of the fourth or fifth aspect as defined above, the back pressure acting on the rear end side of the squeezing foot is adjusted by the back pressure adjustment means, whereby it is possible to maintain the pressurizing force applied to the casting sands at a predetermined value.

A sixth or seventh aspect of embodiments of the present invention is defined as follows. That is, in the electric squeeze device defined in the fourth aspect corresponding to the sixth aspect, or the fifth aspect corresponding to the seventh aspect, a value of the back pressure corresponding to a target pressurizing force is set as the threshold value, and when the squeezing frame is lowered with a pressurizing force higher than the target pressurizing force, the squeezing foot after coming into contact with the casting sands is retracted to the cylinder portion side, and the pressurizing force applied to the casting sands is controlled to reach the target pressurizing force.

In the molding operation, it is desirable to maintain the target pressurizing force against the casting sands for a predetermined period of time in order to stabilize the compression allowance of the casting sands constituting a mold. According to the electric squeeze device of the sixth or seventh aspect, during the lowering operation of the squeezing frame, it is possible to maintain the target pressurizing force against the casting sands for a predetermined period of time.

BRIEF DESCRIPTION

Some of the embodiments will be described in detail, with references to the following Figures, wherein like designations denote like members, wherein.

DETAILED DESCRIPTION

Figure 1:
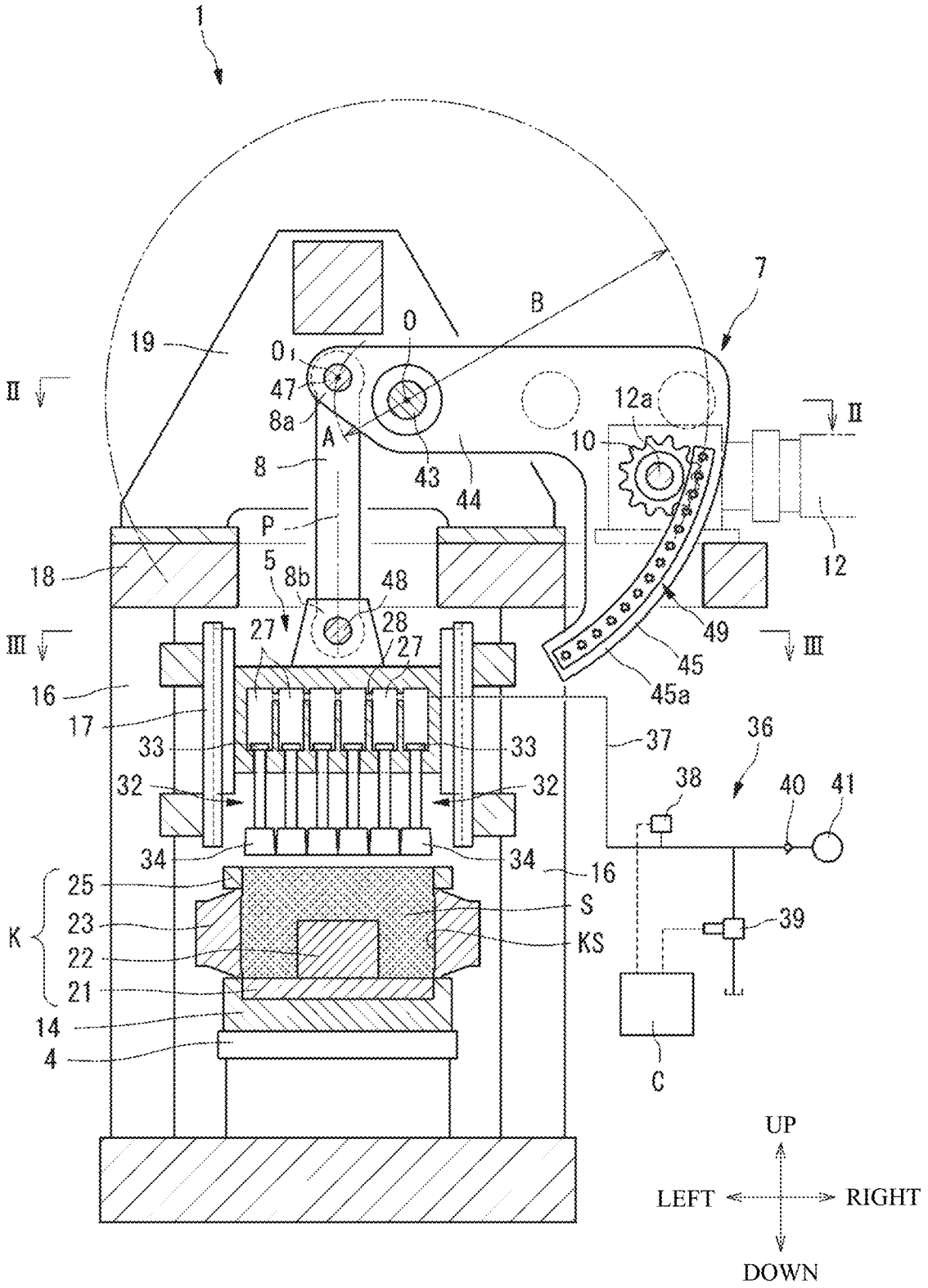
FIG. 1 is a longitudinal sectional view of an electric squeeze device according to a first embodiment of the present invention.

Hereinafter, embodiments of the present invention will be explained with reference to the drawings.

First, an electric squeeze device 1 according to a first embodiment of the present invention will be explained with reference to FIGS. 1 to 4. The electric squeeze device 1 is configured to include a squeezing table 4 that supports a molding flask 23 and the like, a squeezing frame 5 that applies a pressurizing force to casting sands S in the molding flask 23, a swing arm 7 located on the upper side of the squeezing frame 5, a link 8 disposed between the squeezing frame 5 and the swing arm 7, a pinion gear 10 that swings the swing arm 7, an electric motor 12 that rotationally drives the pinion gear 10, and a control unit C that controls the operations of the electric motor 12 and the like, and compresses the casting sands S filled in the molding flask 23 from above to make a mold.

In the present embodiment, the shape of the mold to be made is defined by a pattern plate 21 which is a rectangular plate, a pattern 22 attached to the upper surface of the pattern plate 21, the molding flask 23 which corresponds to the outer shape of the pattern plate 21 and surrounds the periphery of the pattern 22, and a filling frame 25 stacked on the upper end portion of the molding flask 23. That is, a molding space KS corresponding to the shape of the mold is formed inside a molding box K assembled from these members, and the casting sands S are charged into this molding space KS. The molding box K and the casting sands S charged therein are supported by the squeezing table 4 via a carrier plate 14 that moves in a direction orthogonal to the paper surface illustrated in FIG. 1.

Note that, although the casting sands S to be charged into the molding box K are charged more as much as an amount corresponding to the amount of the filling frame 25 stacked on the molding flask 23, the casting sands S are pressurized thereafter so that the charged casting sands S are compressed to such a volume to substantially fit in the molding flask 23, thereby making the compacted mold.

The squeezing frame 5 is a member for applying a pressurizing force to the casting sands S charged into the molding space KS, and is disposed while facing the squeezing table 4. The squeezing frame 5 is configured to be slidable in the up-down direction along a sliding guide 17 attached to a column 16 constituting a part of a device frame, and is connected to a lower end portion 8*b* of the link 8 so as to be relatively rotatable via a connecting shaft 48 attached to the upper portion.

On the lower surface side of the squeezing frame 5, a plurality of squeezing feet 32 having tips thereof directed toward the molding space KS are suspended so as to be movable forward and backward. The squeezing foot 32 is a member including a foot piston portion 33 on the rear end side and a pressurizing head 34 on the front end side, and the foot piston portion 33 on the rear end side is accommodated in a cylinder portion 27 formed in the squeezing frame 5. The inside of the cylinder portion 27 is filled with oil, and when the squeezing foot 32 pressurizes the casting sands S with the pressurizing head 34 at the tip thereof, the pressurizing force is defined by the hydraulic pressure (that is, the back pressure acting on the foot piston portion 33) in the cylinder portion 27.

Figure 3:
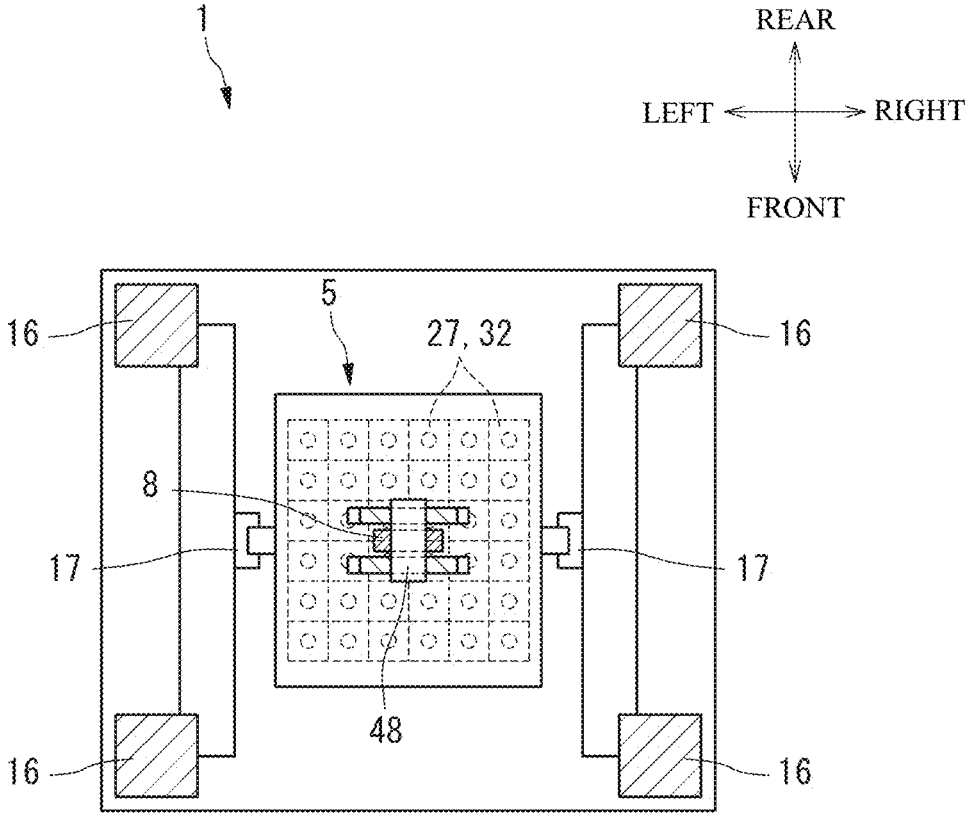
FIG. 3 is a cross-sectional view taken along arrowed line III-III of FIG. 1.

A plurality of cylinder portions 27 are formed in the squeezing frame 5. These cylinder portions 27 are mutually connected through communication holes 28 formed at the upper end portions thereof, and the same hydraulic pressure acts on all the cylinder portions 27. Therefore, a uniform pressurizing force is generated in all the squeezing feet 32 fitted to the cylinder portions 27. As shown in FIGS. 1 and 3, the squeezing feet 32 configured as described above are arranged in parallel in the front-rear direction and the left-right direction so as to correspond to substantially the entire area of the molding space KS in the molding flask 23, whereby it is possible to evenly pressurize the casting sands S charged into the molding flask 23.

In FIG. 1, 36 represents a back pressure adjustment means that adjusts a back pressure acting on the foot piston portion 33. The back pressure adjustment means 36 is configured to include an oil passage 37 communicated with the cylinder portion 27, a pressure sensor 38 that is provided on the oil passage 37 and detects the pressure, a pressure control valve 39 that discharges oil in the oil passage 37 to the outside, and the control unit C to which the pressure sensor 38 and the pressure control valve 39 are connected.

In the back pressure adjustment means 36, when the squeezing foot 32 pressurizes the casting sands S, the back pressure acting on the rear end side of the squeezing foot 32 is detected by the pressure sensor 38, and when the detected back pressure exceeds a predetermined threshold, oil is discharged from the oil passage 37 communicated with the cylinder portion 27 so that the back pressure can be decreased to a set threshold.

A hydraulic pump 41 is disposed at a terminal portion of the oil passage 37 via a check valve 40. The hydraulic pump 41 is used to return the squeezing foot 32 retracted to the cylinder portion 27 side in the operation of pressurizing the casting sands S to be described later, to the advancing end which is the initial position, and the discharge pressure thereof is set to a low pressure of about 1 MPa.

Figure 2:
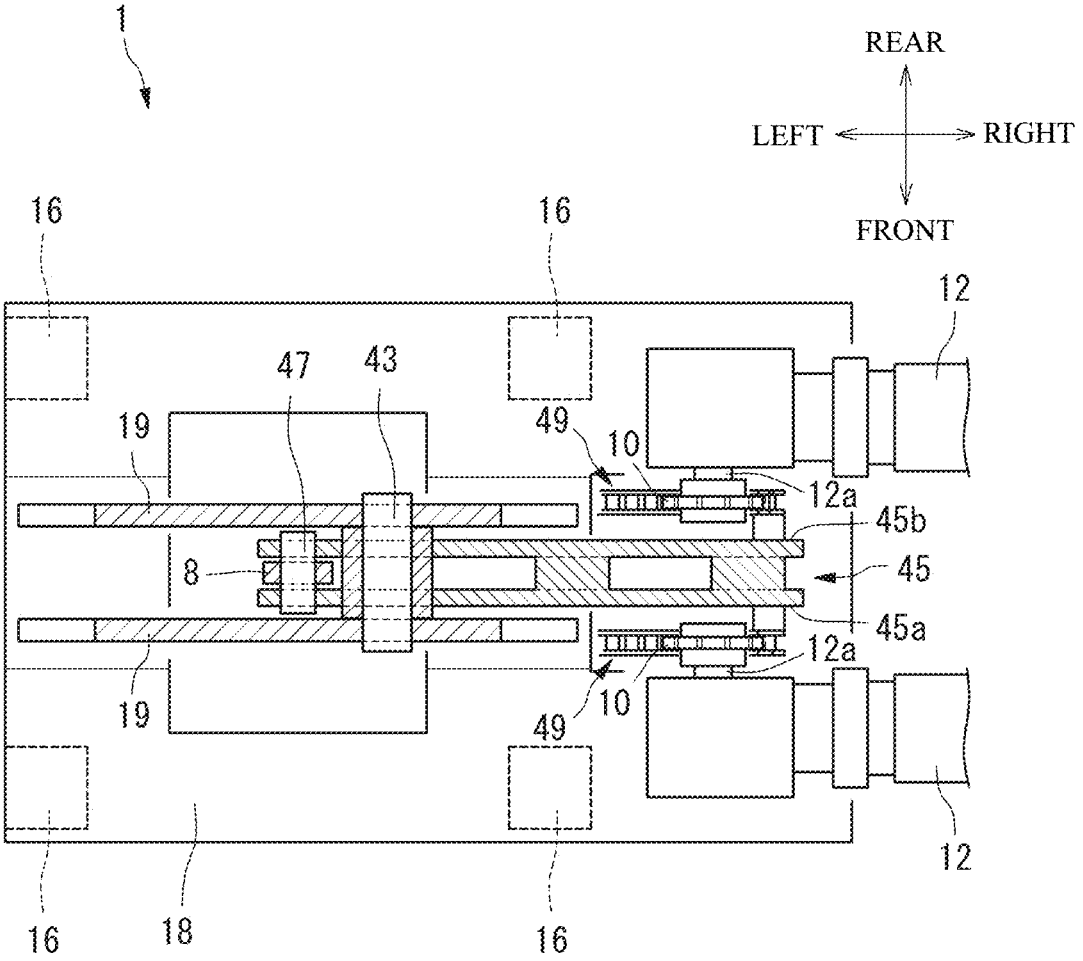
FIG. 2 is a cross-sectional view taken along arrowed line II-II of FIG. 1.

The swing arm 7 is a member that is located on the upper side of the squeezing frame 5 and reciprocates at a predetermined angle around the rotation center O. As illustrated in FIGS. 1 and 2, the fixed shaft 43 is attached so as to extend across two lateral plates 19 and 19 extending from an upper plate 18 fixed to the upper end of the column 16 further upwardly, and the swing arm 7 is connected to the fixed shaft 43 so as to be swingable.

The swing arm 7 includes a first extending portion 44 extending in the radial direction through the rotation center O and a second extending portion 45 extending in the circumferential direction from the end portion of the first extending portion 44 in the front view illustrated in FIG. 1. The rotation center O in the swing arm 7 is located at a position shifted rightward in the drawing from an axis line P passing through the center of the squeezing frame 5 in the left-right direction and extending in the up-down direction. A connecting shaft 47 is attached to a tip, of the first extending portion 44, intersecting the axis line P, at a position of a radius of rotation A from the rotation center O, and an upper end portion 8*a* of the link 8 is connected to the connecting shaft 47 so as to be relatively rotatable. The upper end portion 8*a* of the link 8 connected as described above moves along the locus of the radius of rotation A when the swing arm 7 swings.

In the present embodiment, the pinion gear 10 as a drive gear and the rack-shaped gear 49 as a driven gear constitute a power transmission mechanism for transmitting the driving force of the electric motor 12 to the swing arm 7. The pinion gear 10 serving as a drive gear is connected to an output shaft 12*a* of the electric motor 12. The rack-shaped gear 49 meshing with the pinion gear 10 is formed in the second extending portion 45 of the swing arm 7, and the meshing portion is curved in an arc shape along a virtual arc of the radius of rotation B from the rotation center O. Specifically, a plurality of pins constituting a meshing portion are continuously provided along the virtual arc of the radius of rotation B.

When the pinion gear 10 rotates around the output shaft 12*a*, the rack-shaped gear 49 and the swing arm 7 meshed with the pinion gear 10 are forced to move along the virtual arc of the radius of rotation B.

In the present embodiment, as illustrated in FIG. 2, the rack-shaped gear 49, the pinion gear 10, and the electric motor 12 are provided on each of a front surface 45*a* side and a rear surface 45*b* side of the second extending portion 45.

In the present embodiment configured as described above, when a normal and reverse rotation of the pinion gear 10 is caused by the electric motor 12, the swing arm 7 swings around the rotation center O, and the squeezing frame 5 moves up and down in the up-down direction via the link 8 connected to the first extending portion 44 of the swing arm 7. The swing angle of the swing arm 7 for the generation of a predetermined raising and lowering stroke in the squeezing frame 5 is desirably set within a range of, for example, 50 degrees or less in order to prevent the occurrence of a large inclined load due to the link 8 with respect to the squeezing frame 5.

The downward pressurizing force applied to the squeezing frame 5 is varied depending on the ratio between the radius of rotation A and the radius of rotation B in the swing arm 7 in addition to the driving force of the electric motor 12. According to the present embodiment, the size of the radius of rotation B is set to be larger than the size of the radius of rotation A so as to increase the downward pressurizing force applied to the squeezing frame 5.

Note that, in the present embodiment, a servomotor is used as the electric motor 12. When the swing arm 7 is swung by using the two electric motors 12, in order to synchronously control these electric motors 12, it is desirable to drive one of the two electric motors as a master and the other as a slave. In some cases, an inverter-controlled motor may be used as the electric motor 12.

Figure 4:
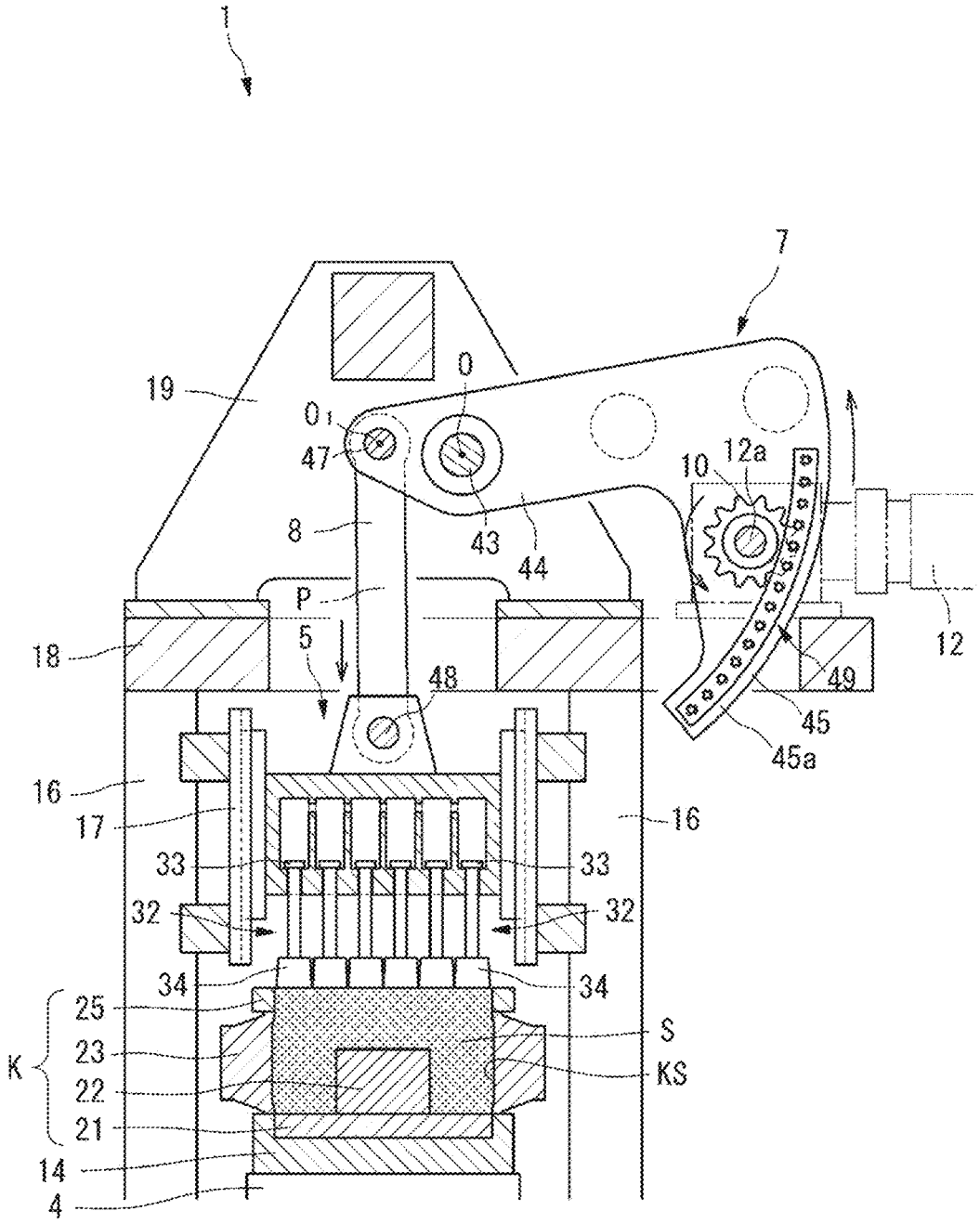
FIG. 4 is an explanatory view of an operation procedure at the time of molding in the electric squeeze device of FIG. 1.

Next, a molding procedure in the electric squeeze device 1 will be explained with reference to FIGS. 1, 4, and 5. Here, a back pressure corresponding to a pressurizing force (target pressurizing force) required to compress the casting sands S during molding is set and registered in the control unit C in advance as the threshold for the back pressure adjustment means 36. When the electric motor 12 is rotationally driven, the downward pressurizing force applied to the squeezing frame 5 via the swing arm 7 is set to be higher than the target pressurizing force.

First, in a state where the molding box K including the molding flask 23 is supported by the squeezing table 4 (see FIG. 1), the electric motor 12 is driven to swing the swing arm 7 around the rotation center O (in the counterclockwise direction) via the pinion gear 10 and the rack-shaped gear 49, whereby the squeezing frame 5 starts lowering. Then, as illustrated in FIG. 4, the tip of the squeezing foot 32 comes into contact with the upper surface of the casting sands S.

Figure 5:
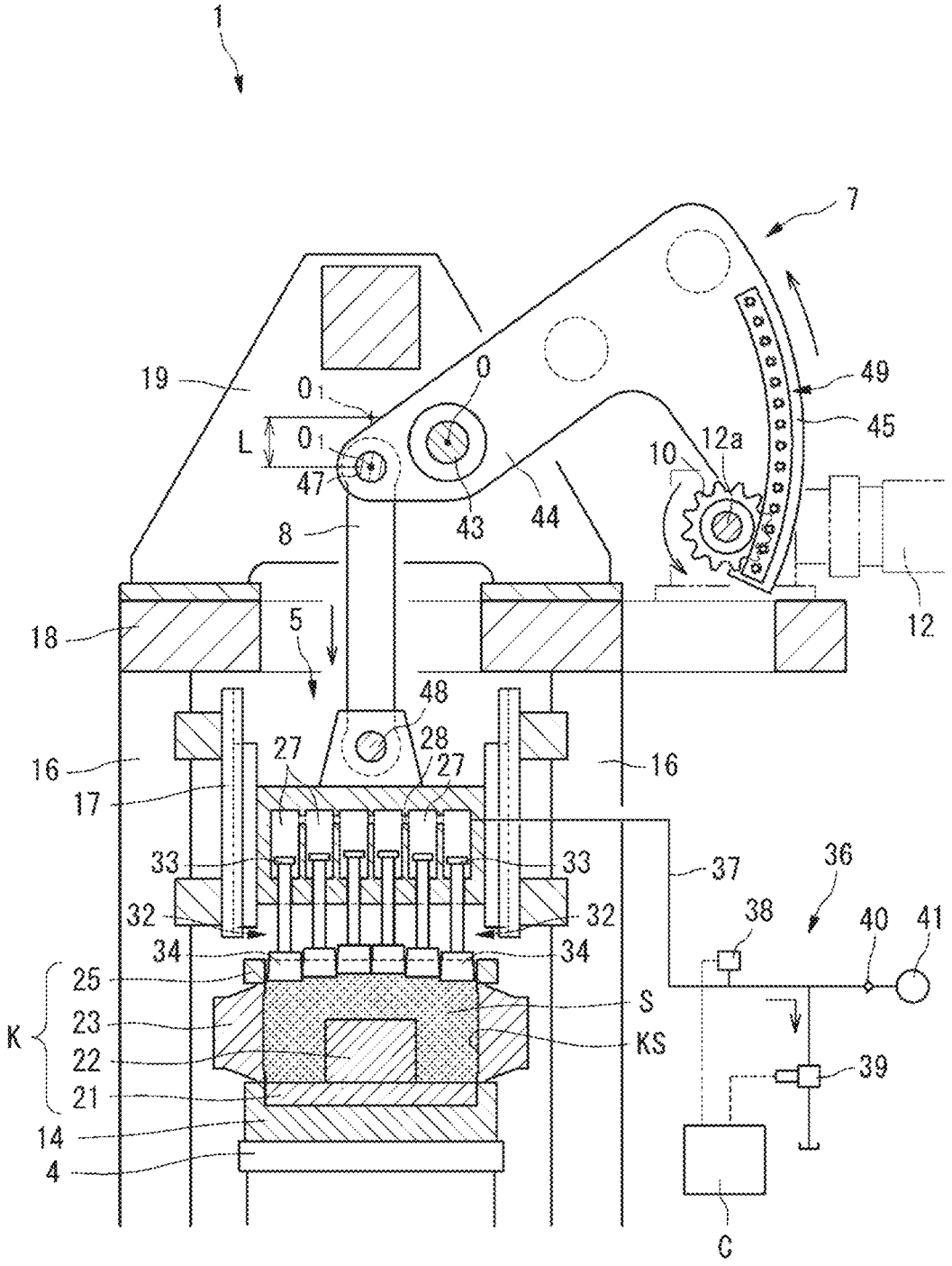
FIG. 5 is an explanatory view following FIG. 4, illustrating the electric squeeze device in a pressurized state.

When the squeezing frame 5 further lowers so as to start pressurizing the casting sands S by the squeezing foot 32, the squeezing foot 32 is retracted to the cylinder portion 27 side as illustrated in FIG. 5, and the hydraulic pressure in the cylinder portion 27 (back pressure acting on the squeezing foot 32) increases. When the pressure sensor 38 detects that the back pressure has reached a preset threshold, the pressure control valve 39 is opened to release oil from the oil passage 37, and the back pressure decreases to the set threshold (after the back pressure falls to the threshold, the pressure control valve 39 is closed). As described above, in the present embodiment, after the threshold (target pressurizing force) is detected by the pressure sensor 38 during the lowering operation of the squeezing frame 5, the target pressurizing force (specifically, the target pressurizing force or a pressurizing force close thereto) is maintained, as the pressurizing force against the casting sands, for a predetermined period of time, and the mold in which the casting sands S are compacted is made. The time during which the target pressurizing force is maintained is controlled by the control unit C.

Note that, although the respective squeezing feet 32 pressurize the casting sands S with the same pressurizing force, as illustrated in FIG. 5, the squeezing by the squeezing feet 32 is shallow in a section where the pattern 22 is disposed and the depth of the casting sands S is shallow, while the squeezing by the squeezing feet 32 is deep in a portion where the pattern 22 is not disposed and the depth of the casting sands S is deep. For this reason, the positions of the squeezing feet 32 after the pressurizing operation is ended, are different.

After the pressurizing operation is ended, the electric motor 12 is reversely rotated to raise the squeezing frame 5. Subsequently, the molding flask 23 is raised by a conventional means (not illustrated) so as to separate (mold release) the mold and the molding flask 23.

On the other hand, the squeezing foot 32 which has been retracted to the cylinder portion 27 side due to the pressurizing operation is returned to the initial position illustrated in FIG. 1 by activating the hydraulic pump 41 to increase the pressure in the cylinder portion 27.

A series of operations as described above is performed under the control of the control unit C.

As explained above, according to the electric squeeze device 1 of the present embodiment, the electric motor 12 is used as a power source for generating a pressurizing force in place of a hydraulic pump unit, and the size of the radius of rotation B in the swing arm 7 interposed between the electric motor 12 and the squeezing frame 5 is set to be larger than the size of the radius of rotation A (based on the principle of leverage), thereby increasing the downward pressurizing force applied to the squeezing frame 5. This electric squeeze device 1 is configured from simple components without using ball screws or the like, so that it is possible to reduce troubles caused by the maintenance management.

In addition, the electric squeeze device 1 of the present embodiment includes the squeezing foot 32 that is fitted to the cylinder portion 27 formed in the squeezing frame 5 and is movable forward and backward in a contact/separation direction with respect to the casting sands S, and the back pressure adjustment means 36 that detects the back pressure acting on the rear end side of the squeezing foot 32 when the squeezing foot 32 pressurizes the casting sands S, and discharges oil from the oil passage 37 communicated with the cylinder portion 27 to reduce the pressure to a predetermined threshold when the back pressure exceeds the threshold.

Therefore, according to the electric squeeze device 1, the back pressure acting on the rear end side of the squeezing foot 32 is adjusted by the back pressure adjustment means 36, whereby it is possible to maintain the pressurizing force applied to the casting sands S at a predetermined value.

Furthermore, in the electric squeeze device 1 of the present embodiment, a value of the back pressure corresponding to a target pressurizing force is set as the threshold value, and when the squeezing frame 5 is lowered with a pressurizing force higher than the target pressurizing force, the squeezing foot 32 after coming into contact with the casting sands S is retracted to the cylinder portion 27 side, and the pressurizing force applied to the casting sands S is controlled to reach the target pressurizing force by the back pressure adjustment means 36.

Therefore, during the lowering operation of the squeezing frame 5, it is possible to maintain the target pressurizing force against the casting sands S for a predetermined period of time.

Next, an electric squeeze device 1B according to a second embodiment will be explained with reference to FIGS. 6 and 7.

Figure 6:
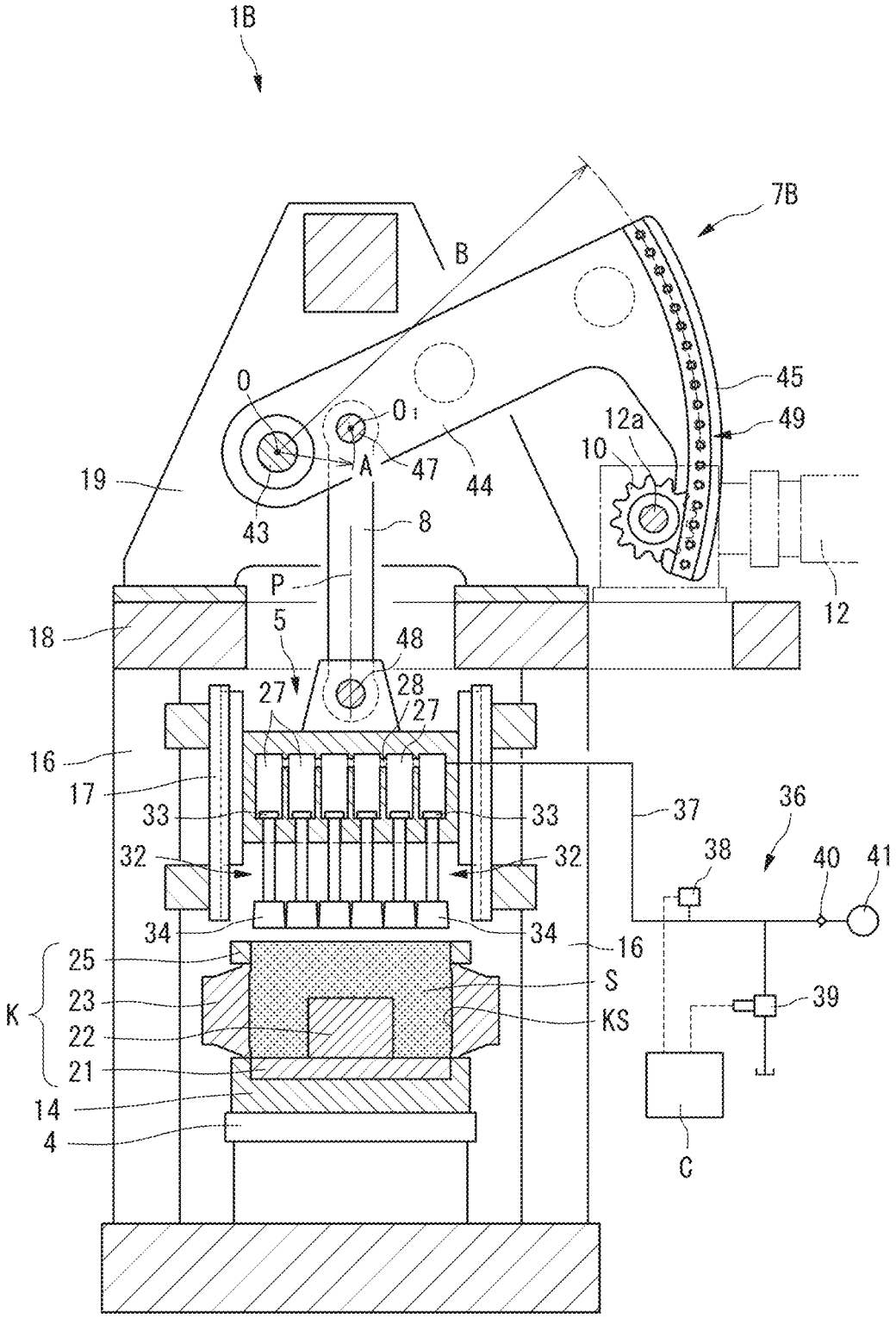
FIG. 6 is a longitudinal sectional view of an electric squeeze device according to a second embodiment of the present invention.

As illustrated in FIG. 6, the electric squeeze device 1B is configured to include the squeezing table 4, the squeezing frame 5, a swing arm 7B, the link 8, the pinion gear 10, the electric motor 12, and the control unit C, and compresses the casting sands S filled in the molding flask 23 from above to make a mold. Among these parts in the configuration, the configuration common to the configuration of the electric squeeze device 1 according to the first embodiment are denoted by the same reference signs, and explanations thereof will be omitted.

In the electric squeeze device 1B, the rotation center O in the swing arm 7B is located at a position shifted leftward in the drawing from an axis line P passing through the center of the squeezing frame 5 in the left-right direction and extending in the up-down direction in the front view illustrated in FIG. 6. In other words, a connecting portion (connection center $O_1$), in the swing arm 7B, with the link 8 is located on the rack-shaped gear 49 side relative to the rotation center O.

Figure 7:
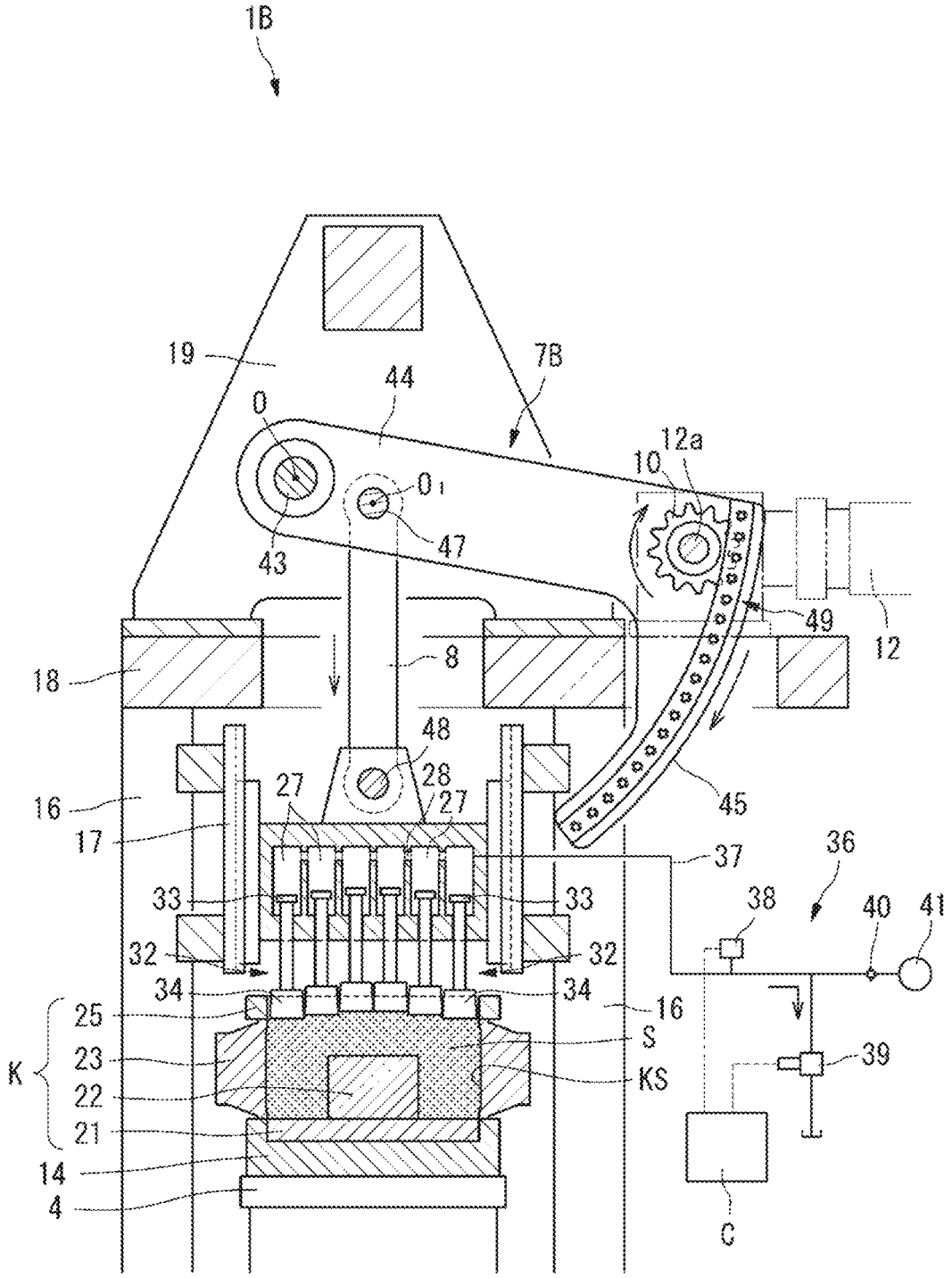
FIG. 7 is a view illustrating the electric squeeze device of FIG. 6 in a pressurized state.

In the electric squeeze device 1B, as illustrated in FIG. 7, the electric motor 12 is driven to swing the swing arm 7B around the rotation center O (in the clockwise direction) so that the squeezing frame 5 is lowered, whereby it is possible to compress the casting sands S with a predetermined pressurizing force.

According to the electric squeeze device 1B of the present embodiment configured as described above, it is possible to increase the proportion of the radius of rotation B with respect to the radius of rotation A without increasing the installation space of the device, and it is possible to further increase the downward pressurizing force applied to the squeezing frame 5, as is obvious from the comparison with FIG. 1 (first embodiment).

Although the embodiments of the present invention have been described in detail above, embodiments of the present invention are not limited to these explanations at all. For example, as for a power transmission mechanism for transmitting the driving force of the electric motor to the swing arm, it is also possible to use a mechanism using a worm gear instead of the rack-shaped gear and the pinion gear of the above embodiment, and various modifications are included in the present invention within the scope that can be easily conceived by a person skilled in the art, without departing from the description in the scope of claims.

In addition, the embodiments of the present invention are used for a so-called "rear surface main squeezing" for compacting the casting sands by pressing the casting sands from above the pattern, but embodiments of the present invention are not limited thereto.

The embodiments of the present invention can be used, for example, for a three-step squeeze including a "preliminary squeezing", a "pattern surface squeezing", and the "rear surface main squeezing".

The "preliminary squeezing" preliminarily presses the molding sand from above the pattern with a smaller force than the rear surface main squeezing.

The "pattern surface squeezing" is performed by raising the pattern surface relative to the molding sand.

Although the present invention has been disclosed in the form of embodiments and variations thereon, it will be understood that numerous additional modifications and variations could be made thereto without departing from the scope of the invention.

For the sake of clarity, it is to be understood that the use of "a" or "an" throughout this application does not exclude a plurality, and "comprising" does not exclude other steps or elements. The mention of a "unit" or a "module" does not preclude the use of more than one unit or module.

REFERENCE SIGNS LIST

1, 1B electric squeeze device
4 squeezing table
5 squeezing frame
7, 7B swing arm
8 link
8*a* upper end portion (one end side)
8*b* lower end portion (another end side)
10 pinion gear (drive gear)
12 electric motor
23 molding flask
27 cylinder portion
32 squeezing foot
33 foot piston portion
36 back pressure adjustment means
37 oil passage
49 rack-shaped gear (driven gear)
A, B radius of rotation
O rotation center
S casting sand

The invention claimed is:

1. An electric squeeze device that compresses casting sands filled in a molding flask from above to make a mold, the electric squeeze device comprising:

a squeezing frame that applies a pressurizing force to the casting sands;

a swing arm that is positioned on an upper side of the squeezing frame and reciprocates at a predetermined angle with respect to a rotation center;

a link having one end side connected to a position of a first radius of rotation from the rotation center of the swing arm and another end side connected to the squeezing frame;

a driven gear formed along a virtual arc of a second radius of rotation from the rotation center of the swing arm;

a drive gear that meshes with the driven gear; and an electric motor that rotationally drives the drive gear, wherein a normal and reverse rotation of the electric motor causes the squeezing frame to move up and down via the swing arm and the link, and a size of the second radius of rotation is set to be larger than a size of the first radius of rotation, thereby increasing a downward pressurizing force applied to the squeezing frame.

2. The electric squeeze device according to claim 1, wherein the driven gear is configured from a rack-shaped gear having a meshing portion provided so as to be curved in an arc shape, and the drive gear is configured from a pinion gear.

3. The electric squeeze device according to claim 1, wherein a connecting portion with the link in the swing arm is located on the driven gear side relative to the rotation center.

4. The electric squeeze device according to claim 3, further comprising:

a squeezing foot that is fitted to a cylinder portion formed in the squeezing frame and is movable forward and backward in a contact/separation direction with respect to the casting sands; and a back pressure adjustment means that detects a back pressure acting on a rear end side of the squeezing foot when the squeezing foot pressurizes the casting sands, and, in a case where the back pressure exceeds a predetermined threshold, discharges oil from an oil passage communicated with the cylinder portion to reduce the pressure to the threshold.

5. The electric squeeze device according to claim 4, wherein:

a value of the back pressure corresponding to a target pressurizing force is set as the threshold value, and when the squeezing frame is lowered with a pressurizing force higher than the target pressurizing force, the squeezing foot after coming into contact with the casting sands is retracted to the cylinder portion side, and the pressurizing force applied to the casting sands is controlled to reach the target pressurizing force.

6. The electric squeeze device according to claim 1, further comprising:

a squeezing foot that is fitted to a cylinder portion formed in the squeezing frame and is movable forward and backward in a contact/separation direction with respect to the casting sands; and a back pressure adjustment means that detects a back pressure acting on a rear end side of the squeezing foot when the squeezing foot pressurizes the casting sands, and, in a case where the back pressure exceeds a predetermined threshold, discharges oil from an oil passage communicated with the cylinder portion to reduce the pressure to the threshold.

7. The electric squeeze device according to claim 6, wherein:

a value of the back pressure corresponding to a target pressurizing force is set as the threshold value, and when the squeezing frame is lowered with a pressurizing force higher than the target pressurizing force, the squeezing foot after coming into contact with the casting sands is retracted to the cylinder portion side, and the pressurizing force applied to the casting sands is controlled to reach the target pressurizing force.

* * * * *